United States Patent [19]

Scheiber

[11] 3,965,854

[45] June 29, 1976

[54] APPARATUS FOR COATING OF HOLLOW BODIES

[75] Inventor: Werner Scheiber, Frankfurt am Main, Germany

[73] Assignee: Metallgesellschaft Aktiengesellschaft, Frankfurt am Main, Germany

[22] Filed: June 3, 1974

[21] Appl. No.: 476,031

[30] Foreign Application Priority Data

June 4, 1973 Germany ..... 2328403
May 21, 1974 Germany ..... 2424558

[52] U.S. Cl. ..... 118/66; 118/314; 118/315; 118/322; 118/DIG. 11

[51] Int. Cl.[2] ..... B05C 5/00; B05C 11/14

[58] Field of Search ..... 118/DIG. 11, 322, 314, 118/320, 66, 643, 324, 315

[56] References Cited

UNITED STATES PATENTS

| | | | |
|---|---|---|---|
| 1,755,634 | 4/1930 | Dewey | 118/66 X |
| 2,011,659 | 8/1935 | Soyland | 118/DIG. 11 |
| 2,346,174 | 4/1944 | Malnar | 118/DIG. 11 |
| 3,411,933 | 11/1968 | Moore | 118/320 X |
| 3,687,704 | 8/1972 | Stanley et al. | 118/DIG. 11 |

*Primary Examiner*—John P. McIntosh
*Attorney, Agent, or Firm*—Karl F. Ross; Herbert Dubno

[57] ABSTRACT

Hollow bodies, e.g. pipes, are coated with protective layers of a liquid or pulverulent material by electrostatic spraying and hardening in which the bodies are disposed horizontally and parallel to one another upon a chain conveyor and are automatically displaced transverse to their longitudinal axes. In a first stage the coating is provided on the hollow bodies exclusively of their end regions and in a second stage the coatings are applied to the end regions.

10 Claims, 6 Drawing Figures

1
2
3
3a
3b
3e
4
4a
4b
5
6
7
8
8'
11
12
13
α
s 1
2
3
3c
3d
4
7
8
9
10
12
13
D
L
S
W 1
2
3
4
5
6
7
8
9
10
11
13
112a
112b

APPARATUS FOR COATING OF HOLLOW BODIES

1. Field of the Invention

The present invention relates to corrosion-resistant or protective coatings for hollow bodies and especially iron and steel tubes, pipes or ducts.

2. Background of the Invention

Unprotected metal pipes, especially iron and steel pipes, which are composed of unalloyed iron-containing compositions and are not protected from corrosion by appropriate coatings, are susceptible to corrosion in the atmosphere to the extent that there is a material reduction in the mechanical loading characteristics of these elements. Corrosion resistance can be increased or improved by alloying the metal with, for example, chromium and nickel, although at relatively high cost, especially since the entire thickness of the body must be provided of alloy steel.

To reduce the cost of this type of corrosion protection it is known to clad the exposed surfaces of ferrous-metal pipes with thin layers of corrosion-resistant metals in an additional step which likewise increases the product cost by introducing a further step in addition to the use of high-cost materials.

It has also been suggested to provide a corrosion-resistant protective coating of synthetic-resin on the external surfaces of iron and steel pipe by introducing the pipe in a heated state into a fluidized bed of the pulverulent synthetic-resin material. The powder adheres to the heated surface and coalesces to form a uniform coating. Special systems must be provided to grip the pipe, generally in an upright state, or to suspend the pipe in the fluidized bed.

It is also known to coat hollow bodies with lacquer-based materials and difficulties have been encountered with such systems as well. Firstly, once the lacquer composition is applied, care must be taken to avoid contact of the coating with any foreign body or substance. This is accomplished generally by mounting the hollow bodies by hand on mandrels of the lacquering machine and removing the coated bodies therefrom. The transport of the bodies is carried out by chain conveyors provided with projecting rods onto which the coated bodies are fitted and the speed of the system must coincide more or less precisely with the capacity of the lacquering machine. Such systems have proved not to be acceptable any longer because of their limited production rates.

Secondly, where lacquer layers have been applied on horizontally arranged bodies with the help of continuous conveyors, the latter have been provided with rotatable supports and spray guns have been employed to apply the lacquer layer. The bodies are then carried through a drying chamber. Periodically the chains must be cleaned to remove accumulated lacquer deposits therefrom and this entails a certain downtime or loss of productivity.

In yet another conventional arrangement, the hollow bodies are carried from the conveyor chain onto turntables and are thereafter transferred again to the conveyor chain, this system having the disadvantage that the transfers must be made by hand or by complex means and that frequently the coating is smeared or otherwise damaged.

OBJECTS OF THE INVENTION

It is the principal object of the present invention to provide improved apparatus for the coating of metallic bodies, especially hollow bodies such as iron and steel pipe, whereby the aforementioned disadvantages are avoided and the output of the system is relatively high.

Another object of the invention is an apparatus for the formation of protective coatings, i.e. anticorrosive coating, upon rotationally symmetrical hollow bodies without the disadvantages of the earlier systems mentioned previously.

Still another object of this invention is to provide an improved system for the electrostatic spray coating of protective layers onto such hollow bodies as iron or steel pipe.

SUMMARY OF THE INVENTION

These objects and other which will become apparent hereinafter are obtained in accordance with the present invention, in a two-stage process for the deposition, preferably by electrostatic spraying, of a corrosion-resistant protective layer onto elongated hollow rotationally symmetrical metallic bodies, hardening the layer, burning the layer into the metal by firing or baking, or increasing the adhesion of the layer by melting, wherein the liquid or pulverulent material is applied to the preferably iron or steel tubes in a single pass or working operation, the hollow bodies lying horizontally and parallel to one another upon a continuously moving chain conveyor running perpendicular to the longitudinal axis of the bodies. According to the invention, the first stage coats the layer onto the hollow bodies over their entire length except in their terminal or end portions while the end portions are coated with the material in a further stage, the separately deposited coating zones being hardened, burned in or melted through (flowed) on the surface upon which they have been deposited.

The apparatus for carrying out this process comprises, according to the invention, two supporting-chain conveyors provided with entrainers and disposed in line with one another (i.e. one behind the other), each consisting of two chain stretches. The spacing of the chain stretches of each conveyor from one another is so arranged that the hollow bodies rest with their end regions upon one chain conveyor or one coating phase and inwardly of there end regions upon the other chain conveyor for the other coating phase or stage so that only an uncoated or previously burned in, hardened or flowed (melted) coating portion contacts the conveyor during the electrostatic spraying of each uncoated portion. The chains extend through spray chambers in which the coatings are applied to the respective portions, and through at least one oven chamber in which the coating is heated for hardening, burning in or flow melting.

Thus one of the supporting-chain conveyors extends past the spray chamber and oven which are straddled by the chain passes of this conveyor, i.e. the chain passes flank the spray and oven chambers are later deposited between the same chain passes while the other chain may pass through a spray chamber and an oven chamber or through a pair of parallel spray chambers and oven chambers. Of course, each of the spray and oven chambers may extend the full width of the respective chain conveyor.

Both of the supporting chain conveyors can be provided in the region of the spray compartments with respective rotatable rolls to rotate the hollow bodies about their longitudinal axes during the spraying process and lifting means to set the hollow bodies into the spray chambers.

It has also been found to be advantageous to provide a further chain pass between the chain passes of one of the conveyors so that this additional or intermediate chain pass horizontally overlaps the main supporting conveyors. This permits tubes of considerable length to be processed in a simple and economical manner. Furthermore, it permits an effective transfer of the metal pipes from one of the supporting chain conveyors to the other.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1A:
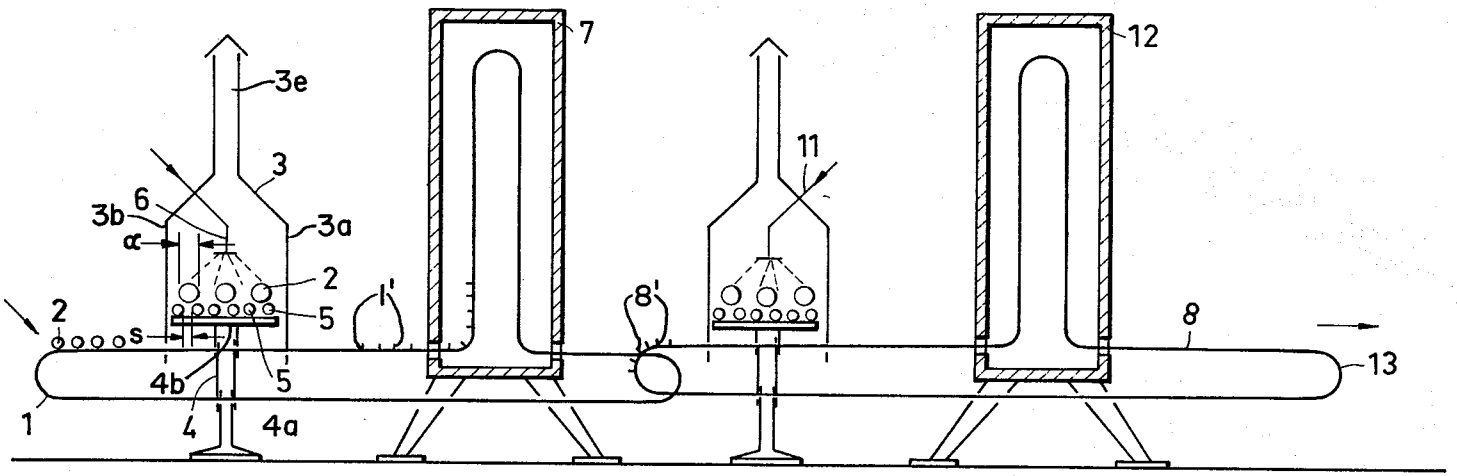
FIG. 1A is a vertical longitudinal cross-sectional view, partly in diagrammatic form, illustrating an apparatus for carrying out the method of the present invention.
Figure 1B:
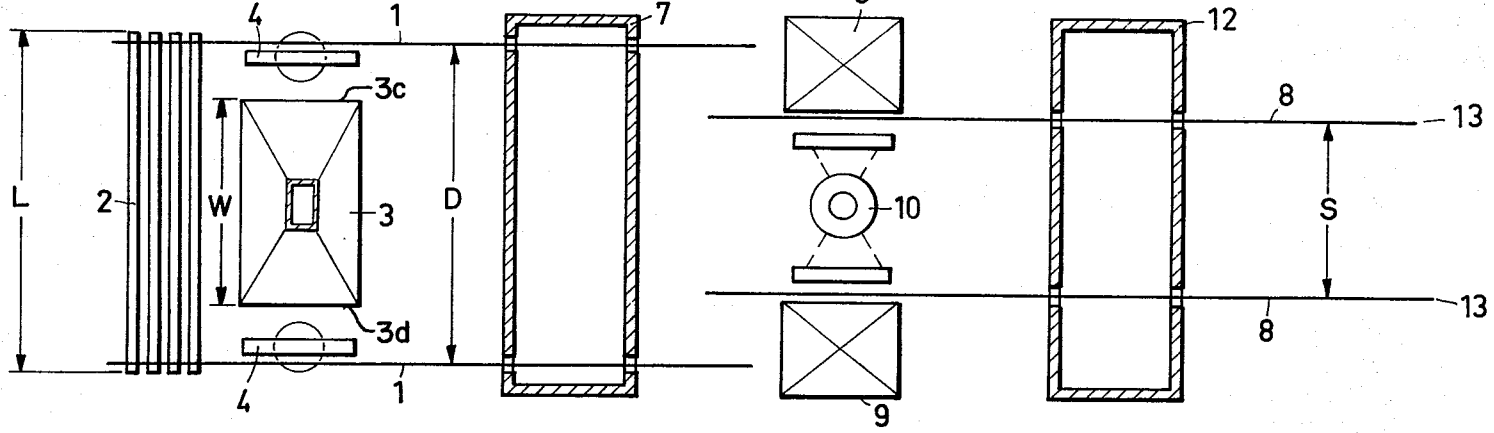
FIG. 1B is a plan view, partly in horizontal section, of the apparatus of FIG. 1A.

The system illustrated in FIGS. 1A and 1B comprises a first supporting, chain conveyor consisting of a pair of endless conveyor chains 1 spaced apart by a distance D which is slightly less than the length L of the pipes to be carried thereby. The chains 1 are provided with upstanding pins 1' shown only over part of the length of the chain and serving to entrain the pipes 2 along a horizontal path in a direction transverse to the longitudinal direction of these pipes by supporting them only at their end regions.

The chains are driven incremently, i.e. to carry a multiplicity of pipes (for example three) into a spray compartment 3 defined within a plurality of walls 3*a*, 3*b*, 3*c* and 3*d* from a hood above the path of the pipes 2. Thus at each step three pipes are carried into the space below the hood and during the next step, the three pipes are carried away and a further three pipes bring into position below the hood.

The spray chamber 3 has a width W which is less than the length L so that only a corresponding region of the central portion of each pipe is coated within these spray compartments.

Flanking the spray compartments 3 are a pair of hydraulic pneumatic lifters 4 having telescoping uprights 4*a* and a platform 4*b* provided with rollers 5 which can be rotated by a motor or other means not shown. The spacing *s* between each pair of rollers 5 is less than the diameter *d* of the pipes whereby the pipes 2 rest upon the rollers 5 at the end portion of the pipe projecting beyond the spray chamber 3 and can be rotated to ensure uniform coating with a lacquer or other composition.

The spray composition is dispensed by a spray head 6 disposed within the chamber and fumes of the spray composition, e.g. solvent vapors, are carried off by the duct 3*e* which is maintained under a subatmospheric pressure. Preferably the spray head 6 is connected to one terminal of an electrostatic power supply, the other terminal of which is connected to the chain 1 so that electrostatic spray deposition is effected. The power supply is, of course, conventional and has not been illustrated in the drawing. The assembly 3, 6 can thus be considered to be an electrostatic spray chamber in which the pipes 2 are uniformly coated over their central region corresponding to a length W upon rotation of the pipe when a group of them is elevated upon the lifters 4.

Upon completion of the spraying of the central portions of the pipes within the chamber 3, the elevated pipes 2 are lowered back on to the supporting chains 1 and are entrained into an oven or dryer 7 which may receive the entire length of pipe and are subjected therein to drying, hardening, flowing and/or baking or firing to produce a thoroughly hardened and insensitive coating at the central region. Thereafter, the pipes 2 are transferred to a second supporting-chain conveyor consisting of a pair of endless chains 8 having a transverse spacing system which is less than the coated length W and also less than the distance D of the chains 1 from one another.

The chains 8 are provided with entraining pins 8' and overlap horizontally interdigitate with the chains 1 so that they lift the pipes 2 from the first conveyor 1 and carry the pipes by their previously coated central regions into a second coating station provided with a pair of spray chambers each straddling the chains 8 and spaced apart by a distance which may be slightly greater than the distance S but it less than that or equal to the width W.

As a consequence, the uncoated end portions of the pipes lie fully within the plan outline or project of the chambers 9. In this case, a central lifter 10 is provided and may engage a group of pipes, e.g. three, at their coated central region between the chain 8 and lift the pipes into the chambers 9 on rollers similar to those shown at 5 and designed to revolve the pipes about their longitudinal axes during coating. The spray chambers 9 are provided with spray heads 11 and with an electrostatic-power supply of conventional design (not shown) for the electrostatic spraying of the end portions of the pipes.

Figures 2A, 2B:
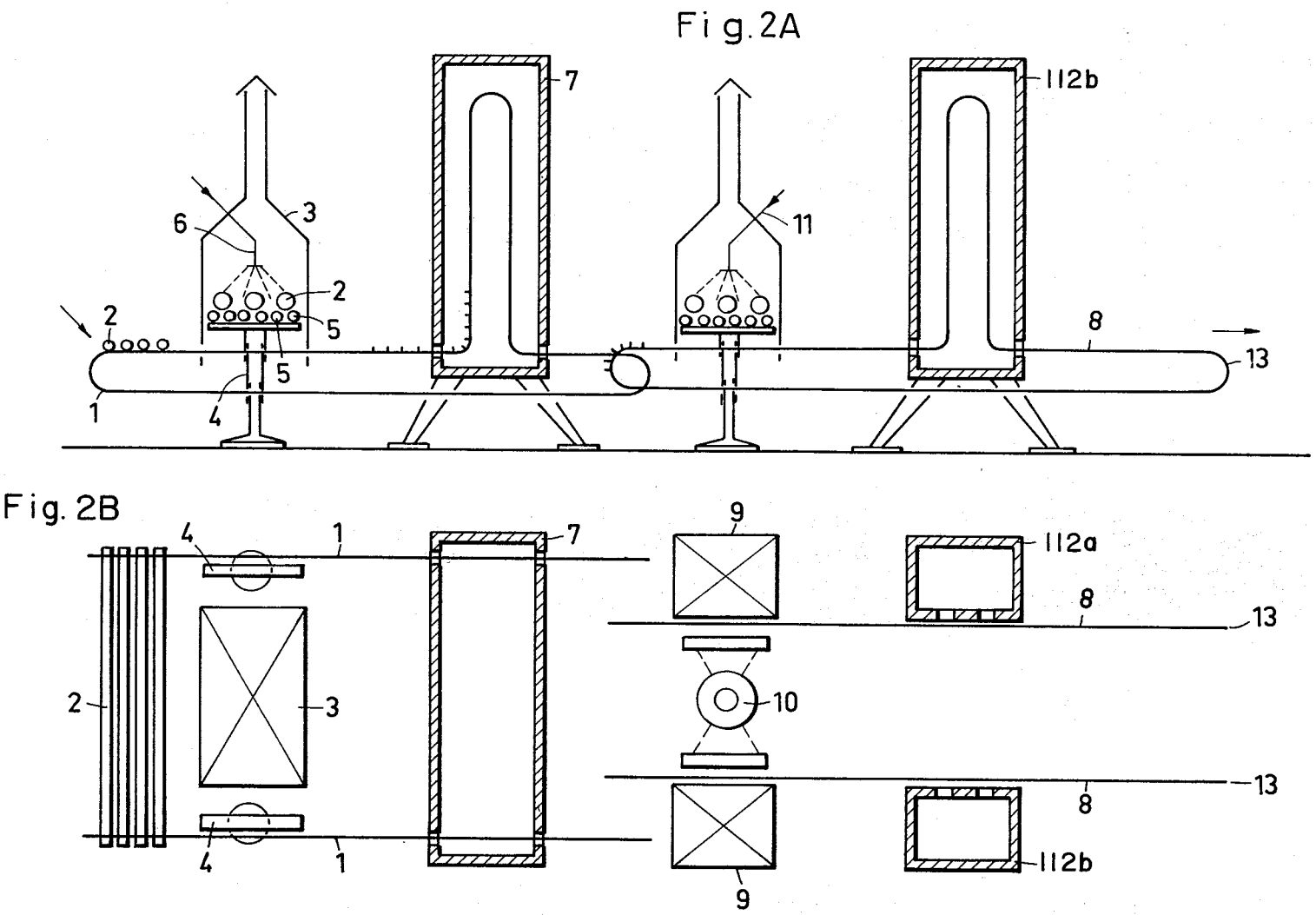
FIG. 2A is a view similar to FIG. 1A but illustrating another embodiment of the invention.
FIG. 2B is a view similar to FIG. 1B but showing the system of FIG. 2A.

The chains 8 are, of course, driven in the same cadence as the chains 1 so that each group of pipes is carried into position below the spray chambers 9, is lifted at 10 into the spray chambers 9 while the chains are immobile, the pipes being lowered back on to the chain and the chain advanced as previously described. The end-coated pipes are then carried into another oven or furnace 12 in which the coatings in the central portion, hardened, baked or fired to complete the coating operation. The furnace 12 here extends the full length of the pipe so that any additional baking of the central portion which may be necessary can be carried out. The pipes are then discharged at the end 13 of the second conveyor consisting of the chains 8. The embodiment of FIGS. 2A and 2B differ from that of FIGS. 1A and 1B in that, in place of the furnace 12 extending the full length of the pipes 2 across the transport path, two furnaces 112*a* and 112*b* are provided to flank the chains 8 and to receive only the newly coated end portions of the pipes. To a large measure, the central portions of the pipes remain cool enough to be handled.

Figure 3A:
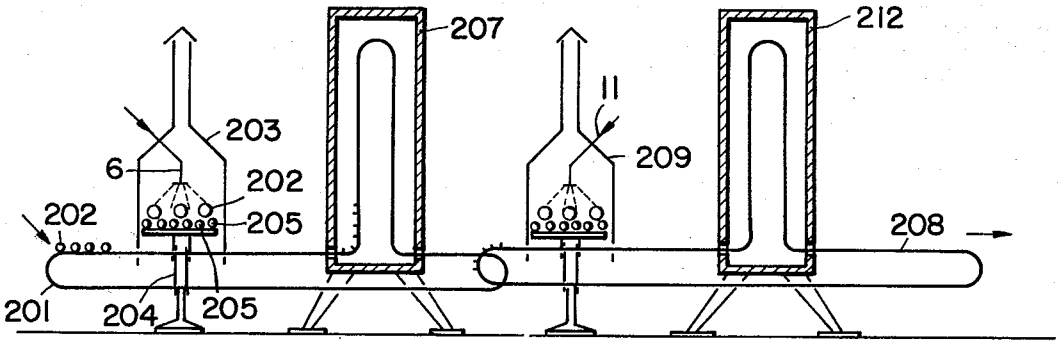
FIG. 3A is another vertical section of an apparatus according to the present invention, again illustrating certain parts diagrammatically.
Figure 3B:
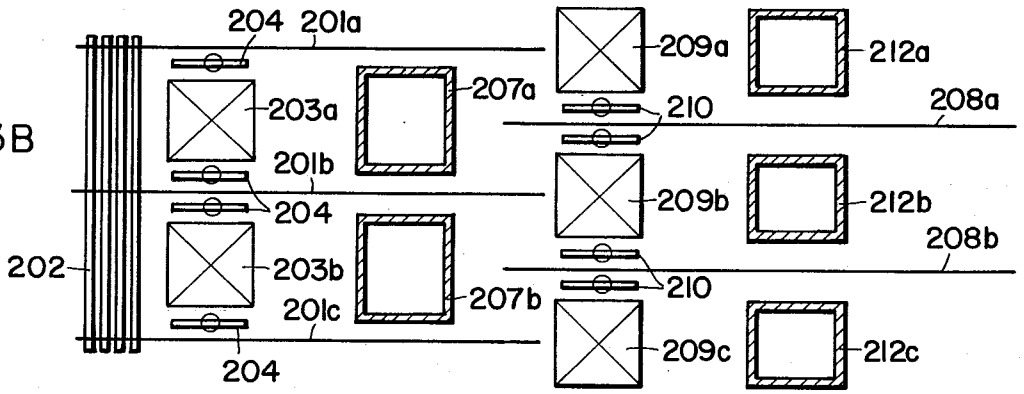
FIG. 3B is a plan view, partly broken away, of the embodiment of FIG. 3A.

The embodiment of FIGS. 3A and 3B comprises a first chain conveyor consisting of three parallel and transversely spaced chains 201*a*, 201*b*, and 201*c*, the chains 201*a* and 201*c* performing the same function as the chains 1 of the embodiment of FIGS. 1A, 1B and 2A, 2B, while the intermediate chains 201*b* provide additional support at a central portion of the pipes 202. The pipes 202 can thus be substantially longer than the pipes 2 or of smaller diameter for a given length. The chain conveyor is represented as a hole at 201.

In this embodiment, two spray chambers 203*a* and 203*b*, constituting a spraying station 203, are provided, one between each pair of chains to coat the zones of the pipes between the chains 201*a* and 201*b* and between the chains 201*b* and 201*c*. Each of the spray chambers 203*a* and 203*b* is provided with a pair of lifters 204 which, as described for the lifter 4, are provided with rollers 205 to rotate the pipe during spraying and are simultaneously sprayed to lift groups of pipes into the spray chambers 203*a* and 203*b*.

The hardening station 207 is here shown to consist of a pair of ovens 207*a* and 207*b*, each of which receives only the portions of the pipes and is disposed between a pair of the chains of conveyor 201.

Received between the pair of chains of conveyor 201 are the chains of the conveyor 208, i.e. the chains 208*a* and 208*b* which engage previously coated and insensitive portions of the pipes 202 and entrain them into a spraying station 209 consisting of three spraying chambers 209*a* and 209*b* and 209*c*, each of which covers a noncoated portion of the pipes. In this case, the lifting devices 210, which are similar to the device 4 previously described, are provided on opposite sides of each chain 208*a* and 208*b*. The coating is thus effected at both end portions of each pipe and the previously noncoated center thereof.

The pipes are then entrained into the ovens 212*a*, 212*b* and 212*c* of a hardened station 212 in which each newly coated portion of each pipe is hardened as previously described.

SPECIFIC EXAMPLES

Example I

Medium-heavy helical-seam pipe of a length of 6 meters and outer diameter of 60.3 mm, a wall thickness of 3.91 mm and a weight of 5.44 kg per running meter are treated in an apparatus as shown in FIGS. 1A and 1B with a protective coating of a "shop primer" of an epoxy resin with a flame point above 21 C and a viscosity of 18 sec in a 4 mm DIN vessel. The coating is applied hydrostatically with a so-called Ransburg bell with a voltage of 120 kV. The cadence of operation is so selected that the pipes spend two minutes in the spray chambers of the first conveyor and 5 minutes in the furnace at 200°C before being transferred to the second conveyor. On the second conveyor, the pipes spend two minutes in the spray chambers thereof and after an additional two minutes in the air are carried into the furnace 12 and treated therein for five minutes. The pipes are permitted to cool for three minutes and are then removed from the second chain conveyor. The coating has a thickness of 30 microns and is highly uniform over the entire length of the pipes.

Example II

The pipes of Example I are coated with an isocyanate hardened phenol copolymer having a flame point about 21°C and a viscosity of 22 sec in a 4 mm DIN vessel. The other spraying parameters were the same as those given in Example I except that the temperatures in the ovens were reduced to 160°C from the 200°C used in Example I. The coating had a thickness of 40 microns and was completely uniform.

Example III

The pipes of Example I were treated with a thermoplastic polyvinylchloride-base-powder lacquer by electrostatic spraying from a commercial powder-spray device with a potential difference of 130 kV. Thereafter with the same parameters as in Example I except that the temperature was 220°C in each oven, the pipes were processed as described. The coating had a thickness of 90 microns and was highly uniform.

I claim:

1. An apparatus for coating rotationally symmetrical elongated bodies comprising at least two in-line successive conveyors defining a transport path for said bodies, each of said conveyors comprising a pair of transversely spaced horizontally extending conveyor chains, the conveyor chains of a first of said conveyors engaging said bodies at first regions of the length of the bodies axially spaced from second regions of engagement by the chains of the second conveyor along the length of each body, said bodies lying athwart said conveyors; first spray means including at least one spray chamber along the path of said first conveyor enclosing only said second regions of said bodies for spraying a hardenable protective layer thereon over only the second regions of said bodies; at least one oven downstream of said first spray means along said transport path for hardening the layers upon said second regions of said bodies; second spray means disposed along the path of said second conveyor and enclosing said first regions of said bodies and spraying respective layers thereon upon said first regions and upon limited lengths of said bodies while said bodies are supported on the hardened layers of said second regions; and at least one second oven along the transport path downstream of said second spray means for hardening the layers disposed on the first regions of said bodies.

2. The apparatus defined in claim 1 wherein the spray means along at least one of said conveyors includes a spraying chamber disposed between the chains of the latter conveyor.

3. The apparatus defined in claim 1 wherein the spray means disposed along one of said conveyors comprises a pair of spray chambers flanking the chains thereof.

4. The apparatus defined in claim 1 wherein at least one of said ovens extends over the full length of the body across the chain of the respective conveyor.

5. The apparatus defined in claim 1 wherein at least one of said ovens includes an oven chamber lying between the chains of the respective conveyor.

6. The apparatus defined in claim 1 wherein at least one of said ovens includes a pair of oven chambers flanking the chains of a respective conveyor.

7. The apparatus defined in claim 1 wherein one of said conveyors includes a further chain disposed between the previously mentioned chains thereof and the respective spray means includes a pair of chambers each disposed between two chains of the latter conveyor.

8. The apparatus defined in claim 7 wherein the spray means of the other conveyor comprises three chambers each aligned with a respective chain of the three-chain conveyor.

9. The apparatus defined in claim 1 wherein at least one of each spray means includes lifting means for elevating at least one pipe from the respective conveyor into a spraying position.

10. The apparatus defined in claim 1 wherein the chains of the two conveyors are interdigitated horizontally.

* * * * *